US005202012A

United States Patent [19]

Abe et al.

[11] Patent Number: 5,202,012

[45] Date of Patent: Apr. 13, 1993

[54] METHOD FOR MANUFACTURING ZINCIFEROUS ELECTROPLATED STEEL SHEET EXCELLENT IN PRESS-FORMABILITY

[75] Inventors: Masaki Abe; Yukimitsu Shiohara; Masaru Sagiyama, all of Tokyo, Japan

[73] Assignee: NKK Corporation, Tokyo, Japan

[21] Appl. No.: 835,202

[22] Filed: Feb. 13, 1992

[30] Foreign Application Priority Data

Mar. 5, 1991 [JP] Japan ..... 3-62425

[51] Int. Cl.[5] ..... C25D 7/06

[52] U.S. Cl. ..... 205/109; 205/155

[58] Field of Search ..... 205/109, 155

[56] References Cited

FOREIGN PATENT DOCUMENTS 0290836 11/1988 European Pat. Off. .
57-149486 9/1982 Japan .
2-190483 7/1990 Japan .

OTHER PUBLICATIONS

Patent Abstracts of Japan, vol. 12, No. 482, Dec. 1988, Abstract of JP-A-63 199899, Aug. 1988.

*Primary Examiner*—T. M. Tufariello
*Attorney, Agent, or Firm*—Frishauf, Holtz, Goodman & Woodward

[57] ABSTRACT

A method for manufacturing a zinciferous electroplated steel sheet excellent in press-formability, which comprises the steps of: electroplating a steel sheet in a zinciferous acidic electroplating solution, which contains nitric acid ions or nitrous acid ions in an amount within a range of from 0.1 to 50 g per liter of the electroplating solution, and oxide particles of a metal or a semimetal, uniformly dispersible into the electroplating solution, in an amount within a range of from 0.1 to under 0.5 g per liter of the electroplating solution, to form, on at least one surface of the steel sheet, a zinciferous electroplating layer in which zinc hydroxide particles having the oxide particles as nuclei thereof are uniformly dispersed.

6 Claims, No Drawings

METHOD FOR MANUFACTURING ZINCIFEROUS ELECTROPLATED STEEL SHEET EXCELLENT IN PRESS-FORMABILITY

REFERENCE TO PATENTS, APPLICATIONS AND PUBLICATIONS PERTINENT TO THE INVENTION

As far as we know, there are available the following prior art documents pertinent to the present invention:

(1) Japanese Patent Provisional Publication No. 57-149,486 dated Sep. 16, 1982; and (2) Japanese Patent Provisional Publication No. 2-190,483 dated Jul. 26, 1990.

The contents of the prior arts disclosed in the above-mentioned prior art documents will be discussed hereafter under the heading of the "BACKGROUND OF THE INVENTION"

BACKGROUND OF THE INVENTION

1. Field of the Invention

The present invention relates to a method for manufacturing a zinciferous electroplated steel sheet excellent in press-formability.

2. Related Art Statement

A zinciferous electroplated steel sheet having a zinciferous electroplating layer comprising zinc or a zinc alloy formed on at least one surface thereof, has many advantages including an excellent corrosion resistance and a low manufacturing cost. The zinciferous electroplated steel sheet is therefore widely used as a steel sheet for an automobile body and as a steel sheet for a home electric appliance.

The zinciferous electroplated steel sheet has however a problem in that it has a press-formability inferior to that of a cold-rolled steel sheet. More particularly, frictional resistance of the zinciferous electroplated steel sheet against a forming die during the press forming is higher than that of the cold-rolled steel sheet against the forming die. As a result, when the zinciferous electroplated steel sheet is subjected to a severe press forming, peeloffs are produced in the zinciferous electroplating layer, and peeled-off pieces of the zinciferous electroplating layer adhere onto the surface of the forming die. When another zinciferous electroplated steel sheet is press-formed with the use of the forming die thus having the peeled-off pieces of the zinciferous electroplating layer adhering onto the surface thereof, serious defects such as flaws may easily be produced in the press-formed zinciferous electroplated steel sheet.

As zinciferous electroplated steel sheets which solve the above-mentioned problems, the following electroplated steel sheets each having a film for improving press-formability formed on the zinciferous electroplating layer are proposed:

(1) A zinciferous electroplated steel sheet having a powdering-preventive film, disclosed in Japanese Patent Provisional Publication No. 57-149,486 dated Sep. 16, 1982, which comprises: a steel sheet; a zinciferous electroplating layer formed on at least one surface of said steel sheet; and a powdering-preventive film in an amount within a range of from 0.2 to 20 g/m$^2$ per surface of said steel sheet, formed on said zinciferous electroplating layer, which film comprises a macromolecular compound resulting from copolymerization of a monomer with $\alpha$-$\beta$ ethylene unsaturated carboxylic acid, and a waxy substance in an amount within a range of from 1 to 40 wt. % relative to said macromolecular compound (hereinafter referred to as the "prior art 1").

(2) A zinciferous electroplated steel sheet excellent in press-formability, disclosed in Japanese Patent Provisional Publication No. 2-190,483 dated Jul. 26, 1990, which comprises: a steel sheet; a zinciferous electroplating layer formed on at least one surface of said steel sheet; and an oxide film comprising mainly zinc oxide, formed on said zinciferous electroplating layer (hereinafter referred to as the "prior art 2").

The above-mentioned prior arts 1 and 2 have however the following problems;

(1) It is necessary to provide a step of forming a film for improving press-formability on the zinciferous electroplating layer, thus resulting in a higher cost for the formation of this film.

(2) The film for improving press-formability, formed on the zinciferous electroplating layer, is scraped off during the press forming, and scraped-off pieces of the film adhere onto the surface of the forming die. It is therefore necessary to remove these pieces of the film adhering onto the forming die. Insufficient removal of the pieces of the film may easily cause production of flaws and other defects in the press-formed zinciferous electroplated steel sheet.

(3) The film for improving press-formability formed on the zinciferous electroplating layer exerts an adverse effect on the formation of a phosphate film and a paint film on the surface of the zinciferous electroplated steel sheet after the press forming. More specifically, a dense phosphate film and a dense paint film cannot be formed on the surface of the zinciferous electroplated steel sheet because of the presence of the film for improving press-formability, leading to easy degradation of the appearance and corrosion resistance of the zinciferous electroplated steel sheet having the phosphate film and the paint film formed thereon. Prior to forming the phosphate film and the paint film described above, therefore, it is necessary to completely remove the film for improving press-formability formed on the zinciferous electroplating layer. The removing operation of the film is not however easy and requires much time and labor, resulting in an increased cost.

Under such circumstances, there is a strong demand for the development of a method for manufacturing a zinciferous electroplated steel sheet excellent in press-formability, in which peeloffs are not produced in the zinciferous electroplating layer during the press forming, without forming a film for improving press-formability on the zinciferous electroplating layer, but such a method has not as yet been proposed.

SUMMARY OF THE INVENTION

An object of the present invention is therefore to provide a method for manufacturing a zinciferous electroplated steel sheet excellent in press-formability, in which peeloffs are not produced in the zinciferous electroplating layer during the press forming, without forming a film for improving press-formability on the zinciferous electroplating layer.

In accordance with one of the features of the present invention, there is provided a method for manufacturing a zinciferous electroplated steel sheet excellent in press-formability, which comprises the steps of:

electroplating a steel sheet in a zinciferous acidic electroplating solution, which contains nitric acid ions or nitrous acid ions in an amount within a range of from 0.1 to 50 g per liter of the electroplating solution, and oxide particles of a metal or a semimetal, uniformly dispersible into the electroplating solution, in an amount within a range of from 0.1 to under 0.5 g per liter of the electroplating solution, to form, on at least one surface of said steel sheet, a zinciferous electroplating layer in which zinc hydroxide particles having said oxide particles as nuclei thereof are uniformly dispersed.

DETAILED DESCRIPTION OF PREFERRED EMBODIMENTS

From the above-mentioned point of view, extensive studies were carried out to develop a method for manufacturing a zinciferous electroplated steel sheet excellent in press-formability, in which peeloffs are not produced in the zinciferous electroplating layer during the press forming, without forming a film for improving press-formability on the zinciferous electroplating layer.

As a result, the following findings were obtained: by electroplating a steel sheet in a zinciferous acidic electroplating solution, which contains nitric acid ions or nitrous acid ions in a prescribed amount, and oxide particles of a metal or a semimetal, uniformly dispersible into the electroplating solution, in a prescribed amount, it is possible to form, on at least one surface of the steel sheet, a zinciferous electroplating layer, in which zinc hydroxide particles having these oxide particles as nuclei thereof are uniformly dispersed. When the zinciferous electroplated steel sheet having the thus formed zinciferous electroplating layer is press-formed, fine cracks starting from the above-mentioned zinc hydroxide particles are produced in the zinciferous electroplating layer, thus causing the stress acting on the zinciferous electroplating layer to be dispersed. Therefore, even if a severe press forming is applied to the zinciferous electroplated steel sheet, peeloffs are never produced in the zinciferous electroplating layer.

The present invention was made on the basis of the above-mentioned findings. Now, the method of the present invention is described.

In the present invention, a steel sheet is electroplated in a zinciferous acidic electroplating solution, which contains nitric acid ions or nitrous acid ions in an amount within a range of from 0.1 to 50 g per liter of the electroplating solution, and oxide particles of a metal or a semimetal, uniformly dispersible into the electroplating solution, in an amount within a range of from 0.1 to under 0.5 g per liter of the electroplating solution.

When the steel sheet is electroplated in the zinciferous acidic electroplating solution, having a pH value within a range of from 1 to 4, which contains the above-mentioned nitric acid ions or nitrous acid ions and the above-mentioned oxide particles of a metal or a semimetal, the pH value of the electroplating solution on the interface of the cathode, i.e., the steel sheet, increases to about 5.6 under the effect of the reduction reaction of the nitric acid ions or the nitrous acid ions. The increase in pH value of the electroplating solution on the interface of the steel sheet converts zinc ions in the electroplating solution on the interface of the steel sheet into zinc hydroxide. As a result, zinc hydroxide is precipitated together with zinc on the surface of the steel sheet as the cathode.

Oxide particles of a metal or a semimetal have a function of causing uniform precipitation and dispersion of zinc hydroxide in the form of particles in the zinciferous electroplating layer. More specifically, when the steel sheet is electroplated in the zinciferous acidic electroplating solution which contains the above-mentioned nitric acid ions or nitrous acid ions and the above-mentioned oxide particles of the metal or the semimetal, zinc hydroxide particles are uniformly precipitated and dispersed in the zinciferous electroplating layer formed on at least one surface of the steel sheet, in a state in which the oxide particles are uniformly dispersed in the zinciferous electroplating layer, and zinc hydroxide is adsorbed by the surfaces of the oxide particles, with the oxide particles as nuclei thereof. It is therefore possible to form, on at least one surface of the steel sheet, a zinciferous electroplating layer in which the zinc hydroxide particles having the oxide particles as the nuclei thereof are uniformly dispersed.

As described above, the zinc hydroxide particles are uniformly dispersed in the zinciferous electroplating layer, thus causing the production of fine cracks, starting from the zinc hydroxide particles, in the zinciferous electroplating layer during the press forming. As a result, stress acting on the zinciferous electroplating layer is dispersed during the press forming, so that a local concentration of stress is prevented. Application of a severe press forming to the zinciferous electroplated steel sheet having such a zinciferous electroplating layer does not therefore cause production of peeloffs in the zinciferous electroplating layer.

The content of the nitric acid ions or the nitrous acid ions in the zinciferous acidic electroplating solution should be limited within a range of from 0.1 to 50 g per liter of the electroplating solution. With a content of nitric acid ions or nitrous acid ions in the zinciferous electroplating solution of under 0.1 g per liter of the electroplating solution, the pH value of the electroplating solution on the interface of the cathode, i.e., the steel sheet does not increase sufficiently, resulting in an insufficient amount of precipitated zinc hydroxide into the zinciferous electroplating layer. It is therefore impossible to prevent the production of peeloffs in the zinciferous electroplating layer through dispersion of the stress acting on the zinciferous electroplating layer during the press forming. When the content of nitric acid ions or nitrous acid ions in the zinciferous acidic electroplating solution is over 50 g per liter of the electroplating solution, on the other hand, the pH value of the electroplating solution on the interface of the cathode, i.e., the steel sheet, increases excessively, and the amount of zinc hydroxide precipitated into the zinciferous electroplating layer becomes too much. As a result, the layer of zinc hydroxide adsorbed by the surfaces of the oxide particles becomes too thicker, or the fraction of zinc hydroxide in excess from the adsorption by the surfaces of the oxide particles flocculates in the zinciferous electroplating layer. The entire zinciferous electroplating layer thus becomes more brittle, leading to easy production of peeloffs in the zinciferous electroplating layer during the press forming.

The content of the oxide particles of the metal or the semimetal in the zinciferous acidic electroplating solution should be limited within a range of from 0.1 to under 0.5 g per liter of the electroplating solution. With a content of the oxide particles in the zinciferous acidic electroplating solution of under 0.1 g per liter of the electroplating solution, the amount of the oxide particles serving as nuclei of the zinc hydroxide particles is too small to cause uniform precipitation and dispersion of the zinc hydroxide particles into the zinciferous electroplating layer. It is consequently impossible to prevent the production of peeloffs in the zinciferous electroplating layer through dispersion of the stress acting on the zinciferous electroplating layer during the press forming. When the content of the oxide particles in the zinciferous acidic electroplating solution is 0.5 g or over per liter of the electroplating solution, on the other hand, the amount of the zinc hydroxide particles precipitated into the zinciferous electroplating layer becomes too much. As a result, electric conductivity of the zinciferous electroplating layer is impaired by the zinc hydroxide particles which are electrically non-conductive, thus leading to a poorer spot-weldability of the zinciferous electroplated steel sheet.

It is necessary that the oxide particles of the metal or the semimetal to be added into the zinciferous acidic electroplating solution are uniformly dispersible into the electroplating solution. The oxide particles of the metal or the semimetal comprise any one selected from the group consisting of silica, alumina and titania. The particle size of the oxide particles should preferably be limited within a range of from 0.005 to 5 μm. With a particle size of the oxide particles of under 0.005 μm, it is difficult to manufacture such fine oxide particles in an industrial scale. With a particle size of the oxide particles of over 5 μm, on the other hand, it becomes difficult to achieve uniform dispersion of the zinc hydroxide particles in the zinciferous electroplating layer.

The pH value of the zinciferous acidic electroplating solution should preferably be limited within a range of from 1 to 4. A pH value of the zinciferous acidic electroplating solution of under 1 causes a decrease in electrolytic efficiency. With a pH value of the zinciferous acidic electroplating solution of over 4, on the other hand, flocculation and precipitation of the oxide particles in the electroplating solution makes it difficult to cause uniform dispersion of the zinc hydroxide particles in the zinciferous electroplating layer.

The plating weight of the zinciferous electroplating layer in which the zinc hydroxide particles are uniformly dispersed should preferably be limited within a range of from 20 to 120 g/m$^2$ per surface of the steel sheet. A plating weight of the zinciferous electroplating layer of under 20 g/m$^2$ per surface of the steel sheet leads to a lower corrosion resistance of the zinciferous electroplating layer. A plating weight of the zinciferous electroplating layer of over 120 g/m$^2$ per surface of the steel sheet leads on the other hand to a poorer press-formability. The plating weight of the zinciferous electroplating layer should more preferably be limited within a range of from 40 to 100 g/m$^2$.

In the present invention, the zinciferous electroplating layer in which the zinc hydroxide particles are uniformly dispersed may contain only zinc as a metal element, or may additionally contain as required at least one of iron, nickel, cobalt and chromium in addition to zinc.

The steel sheet on at least one surface of which the zinciferous electroplating layer in which the zinc hydroxide particles are uniformly dispersed is to be formed, may be a cold-rolled steel sheet or a hot-rolled steel sheet, which is not subjected to a surface treatment, a conventional zinc electroplated steel sheet, or a conventional zinc alloy electroplated steel sheet wherein said zinc alloy contains at least one of iron, nickel, cobalt and chromium in addition to zinc.

As a basic plating solution, a sulfuric acid plating solution, a chloride plating solution, and a mixed plating solution of sulfuric acid and chloride, which are all conventional, may be used. An electric conductivity assistant and/or a glossing agent may additionally be added as required to the above-mentioned basic plating solution.

Now, the method of the present invention is described further in detail by means of examples while comparing with examples for comparison.

EXAMPLES

An acidic zinc electroplating solution having the following chemical composition (hereinafter referred to as the "basic plating solution") was used:

| | |
|---|---|
| zinc sulfate: | 300 g/l, |
| sodium sulfate: | 30 g/l, |
| and | |
| sodium acetate: | 15 g/l. |

Nitric acid ions or nitrous acid ions in an amount within the scope of the method of the present invention and oxide particles of a metal or a semimetal having an average particle size of 0.01 μm in an amount within the socpe of the method of the present invention, as shown in Table 1, were added to the above-mentioned basic electroplating solution to prepare acidic zinc electroplating solutions of the present invention (hereinafter referred to as the "elecctroplating solutions of the invention") Nos. 1 to 8. Then, a cold-rolled steel sheet having a thickness of 0.7 mm was electroplated with an electric current density of 50 A/dm$^2$ in each of the electroplating solutions of the invention Nos. 1 to 8 to form, on one surface of the cold-rolled steel sheet, a zinc electroplating layer in which zinc hydroxide particles were uniformly dispersed.

For comparison purposes, acidic zinc electroplating solutions outside the scope of the method of the present invention (hereinafter referred to as the "electroplating solutions for comparison") Nos. 1 to 10 were prepared by without adding nitric acid ions or nitrous acid ions and oxide particles of a metal or a semimetal, or by adding only any one thereof, or by adding nitric acid ions or nitrous acid ions or oxide particles in an amount outside the scope of the method of the present invention, as shown also in Table 1, to the above-mentioned basic plating solution. Then, a cold-rolled steel sheet having a thickness of 0.7 mm was electroplated with an electric current density of 50 A/dm$^2$ in each of the electroplating solutions for comparison Nos. 1 to 10 to form a zinc electroplating layer on one surface of the cold-rolled steel sheet.

TABLE 1

| | | Nitric acid ions or nitrous acid ions | | Oxide particles | | pH value of | Plating | Press- | |
|---|---|---|---|---|---|---|---|---|---|
| | No. | Kind | Content (g/l) | Kind | Content (g/l) | plating solution | weight (g/m$^2$) | formability (g/m$^2$) | Spot-weldability |
| Electro- | 1 | Nitric | 1.00 | Silica | 0.40 | 2.0 | 40 | 0.05 | ○ |
| plating | | acid ions | | | | | | | |
| solution | 2 | Nitric | 1.00 | Silica | 0.10 | 2.0 | 90 | 0.21 | ○ |
| of the | | acid ions | | | | | | | |

TABLE 1-continued

| | No. | Nitric acid ions or nitrous acid ions Kind | Content (g/l) | Oxide particles Kind | Content (g/l) | pH value of plating solution | Plating weight ($g/m^2$) | Press-formability ($g/m^2$) | Spot-weldability |
|---|---|---|---|---|---|---|---|---|---|
| invention | 3 | Nitrous acid ions | 30.00 | Silica | 0.40 | 1.0 | 60 | 0.35 | ○ |
| | 4 | Nitric acid ions | 0.40 | Silica | 0.40 | 3.0 | 60 | 0.07 | ○ |
| | 5 | Nitric acid ions | 1.00 | Alumina | 0.40 | 2.0 | 60 | 0.15 | ○ |
| | 6 | Nitrous acid ions | 5.00 | Alumina | 0.10 | 1.2 | 90 | 0.42 | ○ |
| | 7 | Nitric acid ions | 10.00 | Titania | 0.40 | 1.0 | 60 | 0.23 | ○ |
| | 8 | Nitrous acid ions | 2.00 | Titania | 0.10 | 1.5 | 60 | 0.09 | ○ |
| Electro-plating solution for com-parison | 1 | — | — | — | — | 2.0 | 60 | 5.20 | ○ |
| | 2 | Nitric acid ions | 1.00 | — | — | 2.0 | 60 | 1.50 | ○ |
| | 3 | Nitric acid ions | 3.00 | — | — | 1.5 | 90 | 3.20 | ○ |
| | 4 | — | — | Silica | 0.40 | 2.0 | 40 | 1.50 | ○ |
| | 5 | — | — | Alumina | 0.40 | 2.0 | 60 | 3.50 | ○ |
| | 6 | Nitric acid ions | 0.05 | Silica | 0.40 | 2.0 | 60 | 1.50 | ○ |
| | 7 | Nitric acid ions | 60.00 | Silica | 0.40 | 2.0 | 60 | at least 10.00 | ○ |
| | 8 | Nitric acid ions | 1.00 | Silica | 0.05 | 2.0 | 70 | 4.50 | ○ |
| | 9 | Nitrous acid ions | 30.00 | Silica | 0.70 | 1.0 | 60 | 0.38 | X |
| | 10 | Nitric acid ions | 10.00 | Titania | 1.00 | 1.0 | 60 | 0.32 | X |

For each of the zinc electroplated steel sheets manufactured with the use of the electroplating solutions of the invention Nos. 1 to 8 and the electroplating solutions for comparison Nos. 1 to 10, a plating weight, press-formability and spot-weldability were investigated. The results of the investigation are shown also in Table 1, together with the pH value of each of the above-mentioned electroplating solutions.

Press-formability was tested by squeezing each of samples of the zinc electroplated steel sheets manufactured with the use of the electroplating solutions of the invention Nos. 1 to 8 and the electroplating solutions for comparison Nos. 1 to 10, by means of a draw-bead tester, measuring the amount of peeloff in the zinc electroplating layer, and evaluating press-formability from the thus measured amount of peeloff.

For the purpose of investigating spot-weldability, the spot-welding was continuously applied, by means of a pair of electrode tips, to each couple of the zinc electroplated steel sheets manufactured with the use of the electroplating solutions of the invention Nos. 1 to 8 and the electroplating solutions for comparison Nos. 1 to 10. The number of spot-welding runs by the above-mentioned pair of electrode tips, at which an appropriate nugget having a diameter of at least a prescribed value could be formed on the welded joint of each couple of the zinc electroplated steel sheets, was counted, and spot-weldability was evaluated on the basis of the thus counted number of spot-welding runs in accordance with the following criteria:

o: at least 5,000 runs; and x: under 5,000 runs.

As shown in Table 1, the zinc electroplated steel sheet manufactured by the use of the electroplating solution for comparison No. 1 not containing the nitric acid ions or the nitrous acid ions and the oxide particles showed a poor press-formability.

The zinc electroplated steel sheets manufactured by the use of the electroplating solutions for comparison Nos. 2 and 3 which, while containing the nitric acid ions in an amount within the scope of the method of the present invention, did not contain the oxide particles, and the zinc electroplated steel sheets manufactured by the use of the electroplating solutions for comparison Nos. 4 and 5 which, while containing the oxide particles in an amount within the scope of the method of the present invention, did not contain the nitric acid ions or the nitrous acid ions, all showed a poor press-formability.

The zinc electroplated steel sheet manufactured by the use of the electroplating solution for comparison No. 6 which, while containing both the nitric acid ions and the oxide particles, had a low content of the nitric acid ions outside the scope of the method of the present invention, the zinc electroplated steel sheet manufactured by the use of the electroplating solution for comparison No. 7 which had a high content of the nitric acid ions outside the scope of the method of the present invention, and the zinc electroplated steel sheet manufactured by the use of the electroplating solution for comparison No. 8 which had a low content of the oxide particles outside the scope of the method of the present invention, all showed a poor press-formability.

The zinc electroplated steel sheets manufactured by the use of the electroplating solutions for comparison Nos. 9 and 10 which, while containing both the nitric acid ions or the nitrous acid ions and the oxide particles, had a high content of the oxide particles outside the scope of the method of the present invention, showed a poor spot-weldability.

In contrast, all the zinc electroplated steel sheets manufactured by the use of the electroplating solutions of the invention Nos. 1 to 8 were excellent in press-formability and showed a satisfactory spot-weldability.

According to the method of the present invention, as described above in detail, it is possible to economically manufacture a zinciferous electroplated steel sheet excellent in press-formability as well as in spot-weldability, in which peeloffs are not produced in the zinciferous electroplating layer during the press forming, without forming a film for improving press-formability on the zinciferous electroplating layer, thus providing industrially useful effects.

What is claimed is:

1. A method for manufacturing a zinciferous electroplated steel sheet excellent in press-formability, which comprises the steps of:

electroplating a steel sheet in a zinciferous acidic electroplating solution, which contains nitric acid ions or nitrous acid ions in an amount within a range of from 0.1 to 50 g per liter of the electroplating solution, and oxide particles of a metal or a semimetal, uniformly dispersible into the electroplating solution, in an amount within a range of from 0.1 to under 0.5 g per liter of the electroplating solution, to form, on at least one surface of said steel sheet, a zinciferous electroplating layer in which zinc hydroxide particles having said oxide particles as nuclei thereof are uniformly dispersed.

2. A method as claimed in claim 1, wherein:

said oxide particles comprise any one selected from the group consisting of silica, alumina and titania.

3. A method as claimed in claim 1, wherein:

said oxide particles have a particle size within a range of from 0.005 to 5 $\mu$m.

4. A method as claimed in claim 1, wherein:

said zinciferous acidic electroplating solution has a pH value within a range of from 1 to 4.

5. A method as claimed in claim 1, wherein:

said zinciferous electroplating layer has a plating weight within a range of from 20 to 120 g/m$^2$ per surface of said steel sheet.

6. A method as claimed in claim 1, wherein:

said zinciferous electroplating layer has a plating weight within a range of from 40 to 100 g/m$^2$ per surface of said steel sheet.

* * * * *